US010420379B2

(12) United States Patent
Pond

(10) Patent No.: US 10,420,379 B2
(45) Date of Patent: Sep. 24, 2019

(54) ELECTRONICALLY CUSTOMIZABLE ARTICLES

(71) Applicant: Renee Pond, Marietta, GA (US)

(72) Inventor: Renee Pond, Marietta, GA (US)

( * ) Notice: Subject to any disclaimer, the term of this patent is extended or adjusted under 35 U.S.C. 154(b) by 207 days.

(21) Appl. No.: 13/972,900

(22) Filed: Aug. 21, 2013

(65) Prior Publication Data

US 2014/0053315 A1 Feb. 27, 2014

Related U.S. Application Data

(60) Provisional application No. 61/742,884, filed on Aug. 21, 2012.

(51) Int. Cl.

| | |
|---|---|
| ***A41D 1/00*** | (2018.01) |
| ***A45C 13/00*** | (2006.01) |
| ***A45C 15/00*** | (2006.01) |
| ***G09F 9/30*** | (2006.01) |
| ***G09F 9/33*** | (2006.01) |
| ***G09F 21/02*** | (2006.01) |
| ***G09F 27/00*** | (2006.01) |
| ***A41D 25/00*** | (2006.01) |
| ***A41D 27/08*** | (2006.01) |

(52) U.S. Cl.

CPC ..... *A41D 1/002* (2013.01); *A45C 13/00* (2013.01); *A45C 15/00* (2013.01); *G09F 9/30* (2013.01); *G09F 9/33* (2013.01); *G09F 21/02* (2013.01); *G09F 27/00* (2013.01); *A41D 25/00* (2013.01); *A41D 27/085* (2013.01); *G09F 2021/023* (2013.01)

(58) Field of Classification Search

CPC ..... G06F 1/163; A41D 1/002; A41D 1/005; A41D 25/00; A41D 27/085; A45C 13/00; A45C 15/00; G09F 9/30; G09F 9/33; G09F 21/02; G09F 27/00; G09F 2021/023

USPC ..... 709/206

See application file for complete search history.

(56) References Cited

U.S. PATENT DOCUMENTS

| | | | | |
|---|---|---|---|---|
| 6,922,149 | B1 * | 7/2005 | Ford | A41D 1/005 340/539.1 |
| 7,751,285 | B1 * | 7/2010 | Cain | G04G 9/0017 368/10 |
| 8,847,760 | B1 * | 9/2014 | Watkins, Jr. | A45C 13/24 340/568.1 |

(Continued)

FOREIGN PATENT DOCUMENTS

WO WO 2007/002078 1/2007

OTHER PUBLICATIONS

Everymac, iPhone Q&A, Jan. 31, 2007, https://everymac.com/systems/apple/iphone/iphone-faq/iphone-how-multi-touch-interface-works-when-developed.html.*

*Primary Examiner* — James E Springer
(74) *Attorney, Agent, or Firm* — Bekiares Eliezer LLP

(57) ABSTRACT

Some implementations of this disclosure provide an electronically customizable article comprising a fashion article selected from the group consisting of a handbag, a shoe, glasses, a tie, and a bowtie wherein the fashion article comprises an electronic visual display, a processor, a communication interface for communication between the fashion article and a network, and a non-transitory computer readable medium containing instructions that, when executed by the processor, causes the fashion article to connect to a server over the network, receive data from the server, and display one or more images associated with the data on the electronic visual display.

14 Claims, 4 Drawing Sheets

(56) References Cited

U.S. PATENT DOCUMENTS 9,384,403 B2 * 7/2016 Wimmer ..... G06K 9/00402
2002/0084901 A1 * 7/2002 Mantyjarvi ..... A41D 1/005 340/573.1
2004/0039786 A1 * 2/2004 Horvitz ..... G05B 19/404 709/207
2004/0144665 A1 * 7/2004 Hartstein ..... A45C 13/02 206/320
2006/0027292 A1 2/2006 Persic
2006/0028430 A1 2/2006 Harary
2006/0061546 A1 * 3/2006 Jong ..... G06F 1/1656 345/156
2006/0166678 A1 * 7/2006 Karaoguz ..... H04M 1/006 455/456.1
2008/0204440 A1 8/2008 Swain
2008/0316183 A1 * 12/2008 Westerman ..... G06F 3/0416 345/173
2009/0027566 A1 1/2009 Wargon
2009/0237912 A1 9/2009 Tsai
2009/0288317 A1 11/2009 Forbes
2009/0310290 A1 12/2009 Tennent
2010/0289971 A1 11/2010 Odland
2010/0315367 A1 12/2010 Moy
2011/0025704 A1 2/2011 Odland
2011/0037777 A1 * 2/2011 Lindahl ..... G06F 1/1626 345/619
2012/0163269 A1 7/2012 Shuster et al.
2012/0226117 A1 * 9/2012 Lamego ..... A61B 5/14532 600/316
2013/0120106 A1 * 5/2013 Cauwels ..... G06F 1/163 340/3.1
2013/0141439 A1 * 6/2013 Kryzhanovsky ..... G06T 13/80 345/473
2013/0342521 A1 * 12/2013 Griffiths ..... H05B 37/0236 345/212
2014/0221085 A1 * 8/2014 Suto ..... A63F 13/87 463/31
2014/0379273 A1 * 12/2014 Petisce ..... G06F 19/00 702/19
2015/0187327 A1 * 7/2015 Francis ..... G06F 3/014 345/589
2016/0188929 A1 * 6/2016 Gerrity ..... G02B 27/017 340/10.1
2017/0095025 A1 * 4/2017 Ahmadshahi ..... A41C 3/005

* cited by examiner

ELECTRONICALLY CUSTOMIZABLE ARTICLES

CROSS REFERENCE TO RELATED APPLICATION

This application claims the benefit of U.S. Provisional Patent Application No. 61/742,884, which was filed on Aug. 21, 2012, and is incorporated herein by reference in its entirety.

TECHNICAL FIELD

This disclosure relates to electronically customizable articles.

BACKGROUND

Most current article options limit consumers to one design or one color and do not provide the option of personalizing the article. Thus, users are forced to collect different articles to meet each wardrobe, home decor, and social event requirement. This may be expensive. Existing options currently on the market that allow for some color, design, and/or style versatility of an article are interchangeable shells, reversible items, and a small selection of interchangeable fabrics. These existing options provide limited color and design versatility for consumers.

DETAILED DESCRIPTION

Figure 1:
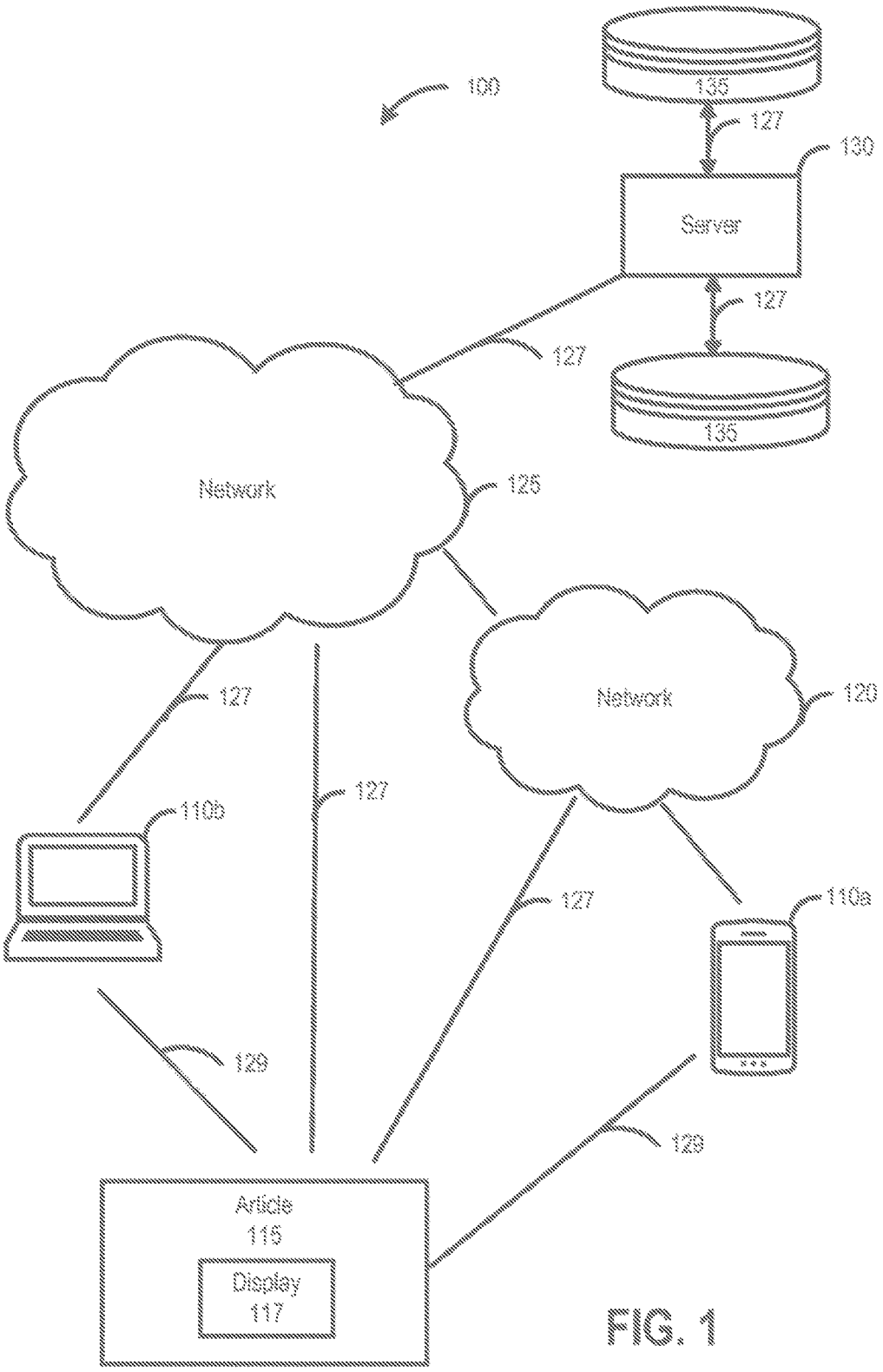
FIG. 1 illustrates an example environment of the present disclosure for setting or changing the outer appearance of an electronically customizable article.

Systems and methods of this disclosure allow a user to set or change the outer appearance of an electronically customizable article (e.g., a handbag). Implementations of the electronically customizable articles may include an electronic visual display such as a flat panel display device to display a user-selected or created color, design, pattern, image, slideshow, video, or other electronic visual display on the exterior of the article.

In some implementations, the electronic visual display may form an outer surface of the article. In some implementation, the electronic visual display may be integral with the article. In some implementations, the electronic visual display may be removable from the article.

In some implementations, the electronic visual display may be a flexible digital display canvas. In some implementations, the electronic visual display may be a touch screen. In some implementations, the electronic visual display may be a liquid crystal display (LCD), light emitting diode (LED), organic light-emitting diode (OLED), interferometric modulator display (IMOD), or plasma, electronic display screen, or any other present or future developed electronic display screen technology.

In some implementations, the electronically customizable article may serve as a computing device such as a laptop, a smartphone, a mobile telephone, a tablet-style computer, or any other handheld electronic device. In some implementations, the electronically customizable article may include an operating system (OS) and may be configured to run one or more application software. In some implementations, the electronically customizable article may include Wi-Fi, Bluetooth, and GPS capabilities to, among other things, allow the electronically customizable article to connect to the Internet and other Bluetooth-capable devices.

Implementations of this disclosure may include hardware and software to create a user interface for a user to select or create a visual display to be displayed on the electronically customizable article. The hardware and software for the user interface may be included in the electronically customizable article, a separate computing device, or on a remote server in combination with either the electronically customizable article or a separate computing device. The hardware and software for the graphical user interface may be configured to permit the user to select, create, or edit images, designs, colors, patterns, and video or media content. In some implementations, the software for the user interface may be downloaded to the electronically customizable article.

In some implementations, the hardware and software for the graphical user interface may be configured to permit the user to manipulate images through, for example, color, color depth, brightening and contrast adjustments, special effects, multiple image merging, softening options, sharpening abilities, image enhancing, image rotating, selective color changing, options of adding and removing elements, cropping, size and orientation adjustments (e.g. landscape or portrait format) and image layering.

In some implementations, the hardware and software for the graphical user interface may be configured to permit the user to animate portions of a still image (e.g., object in continuous motion with still background).

In some implementations, the hardware and software for the graphical user interface may be configured to permit the user to add lighting-show to still image (e.g., pulsating or flashing light emitted from portions of the image) with transfer and display lighting effect images to article.

In implementations where the hardware and software for the user interface or a portion thereof may be embodied in a separate computing device or remote server, the user-selected or created display may be transferred to the electronically customizable article via a wire-based or wireless network. In some implementations, the wireless network may include a WI-FI network, a wireless cellular network, a Wi-Max network, a long-range wireless data network, an ad hoc network, a personal area network (PAN) (such as BLUETOOTH), a local area network (LAN), a wide area network (WAN), a metropolitan area network (MAN), one or more portions of the Internet, or a combination of two or more of these networks. In some implementations, the user-selected or created display may be transferred to the electronically customizable article via cable or connectors (e.g., USB cables) or a storage medium such as a flash drive, memory card, or other data storage device.

Figure 2A:
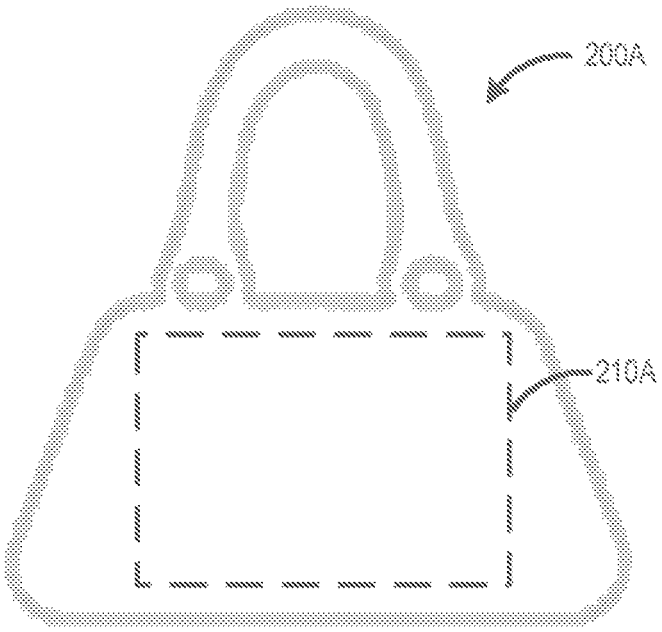
FIGS. 2A-2B illustrate example electronically customizable articles.
Figure 2B:
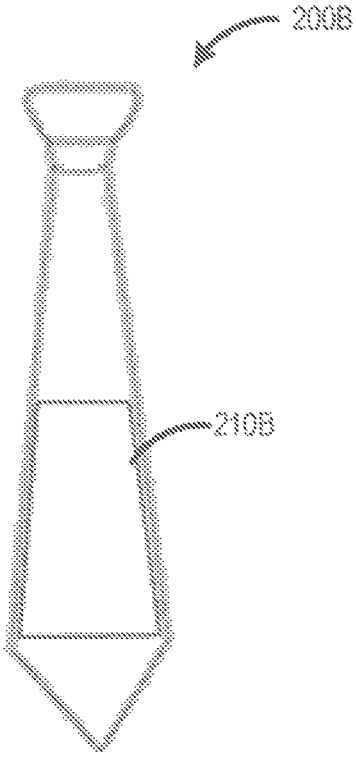

FIGS. 2A-2B illustrate example electronically customizable articles 200A and 200B, respectively. The electronically customizable articles 200A and 200B may include an electronic visual displays 210A and 210B such as a flat panel display device to display a user-selected or created electronic visual display. The electronic visual display on the electronically customizable article may be user-created, downloaded from a remote server, transferred from a local computing device or portable storage media, ordered, or a pre-existing image stored locally (e.g., in the electronically customizable articles) or remotely, for example.

In alternative implementations, the electronically customizable articles 200A and 200B may be, for example, shoes, all types of purses, bags, hats, belts, bracelets, necklaces, earrings, rings, scarves, sunglass and eyeglass frames, gloves, clothing apparel, backpacks, book covers, portfolio cases, ties, bow ties, cufflinks, wallets, laptop lids, name tags, suitcases, briefcases, laptop bags, head phones, head bands and other hair accessories, pet collars, pet leashes, and other pet accessories, undergarments, watches, furniture, luggage, lamps, picture frames, lunch boxes, socks, beverage sleeves, dishware plates, bowls and silverware, key chains, skateboards, roller skates, bikes, all occasion decorations and centerpieces, all writing utensils, all clothing and outerwear and phone and other small electronic cases.

In some implementations, the electronic visual display may form an outer surface of the article. In some implementations, all, substantially all, or a portion of the exterior view of the electronically customizable article may comprise an electronic visual display to customize all, substantially all, or a portion of the electronically customizable article, respectively.

In some implementations, the electronic visual displays (e.g., 210A and 210B) may be integral with the electronically customizable article. In some implementations, the electronic visual display may be removable from the article.

In some implementations, the electronic visual display may be a flexible digital display canvas. In some implementations, the electronic visual display may be a touch screen. In some implementations, the electronic visual display may be a liquid crystal display (LCD), light emitting diode (LED), organic light-emitting diode (OLED), interferometric modulator display (IMOD), or plasma, electronic display screen, or any other present or future developed electronic display screen technology.

In some implementations, the user-selected or created display may include a color, a design, an image, a pattern, a slideshow, a video, media content, or any other electronic visual display. In some implementations, the user-selected or created display may include a specific color such as a PMS, Hex, CMYK, or RGB color, or any other color. In some implementations, the user-selected or created display may include one or more images such as a jpeg, bmp, eps, psd, gif, pdf, raw, and/or tiff image. In some implementations, the user may select the view (e.g., landscape or portrait) for a display.

In some implementations, the electronically customizable article may be configured to rotate a display on the electronic visual display based on the position of the electronically customizable article. For example, in some implementations, the electronically customizable article may include an accelerometer and/or proximity sensors.

In some implementations, an electronic visual display may be placed in multiple locations on the electronically customizable article. In this way, the electronically customizable article may display multiple visual images on different parts of the electronically customizable article simultaneously. In some implementations, the electronically customizable article may display a specified order and timing of images, display multiple visual images on different parts of the article, display stationary images or images in motion, designs, patterns and colors simultaneously. The electronically customizable article also may display a specified order and timing of images, colors, designs, patterns, or multiple visual images simultaneously or in synchronous with one or more other electronically customizable articles such as, for example, shoes and a belt.

In some implementations, a time and/or date, email, or text message notification may be displayed on the electronic visual display. Display options also may consist of a user selected real time news feed, a social media feed, or other informative feeds such as stock market data.

In some implementations, the electronically customizable article may display a media/video clip.

In some implementations, the electronically customizable article may display video during real-time or near real-time video capture.

In some implementations, the electronically customizable article may display live video images, still images, and video playback. In some implementations, the electronically customizable article may include a built in camera to capture and/or record the video or still images. In some implementations, the video or still images may be transferred to the electronically customizable article. In some implementations, the electronically customizable article may include video-teleconferencing abilities including Skype, FaceTime and video chat capabilities.

In some implementations, the electronically customizable article may display a specified order and timing of media/video clip images simultaneously or in synchronous with one or more other electronically customizable articles such as, but not limited to shoes, belts and hats.

In some implementations, the electronic visual display may include a backlight.

In some implementations, an electronic visual display may be located on one or more sides of the electronically customizable article.

In some implementations, the resolution and/or pixel definition and aspect ratio of the electronic visual display may be dependent on the size and style of electronically customizable article.

In some implementations, the electronic visual display and/or electronically customizable article may include glare and reflection reduction features.

In some implementations, the electronically customizable article may include a multi-touch screen and/or handwriting recognition capabilities.

In some implementations, the electronic visual display maybe placed in a locked position thereby disabling any accidental navigation while only displaying the user's desired image.

In some implementations, the electronically customizable article may be used for advertisement purposes.

In some implementations, the electronically customizable article may be configured to display notifications of calendar meetings and set alarms. In some implementations, notifications may consist of a text display, image display, color illumination, an audio signal, vibration, or a combination of the foregoing.

In some implementations, patterns, designs, colors, images, media content along with other content may be ordered or downloaded to the electronically customizable article on a fee basis purchase using financial/accounting management systems allowing for financial arrangements and transactions such as a one-time fee, monthly fee and or yearly subscriptions via computer and mobile applications, computer programs, internet websites and computer software. Some features may be disabled such as the transfer of certain images, designs, patterns, colors and or video content where fee purchase is required for download of material, preventing unauthorized use of image content from designer, artist or creator of downloadable content or material.

In some implementations, images, colors, designs, patterns and design templates may be pre-downloaded, personally ordered via software or computer/mobile applications on a fee basis purpose to display on the electronically customizable article.

In some implementations, the electronically customizable article may include built-in apps such as visual display touch-screen keyboard, time indicator with alarm, weather and calendar display, built in to do list and grocery manager app, drawing/note taking board and flashlight.

In some implementations, the electronically customizable article may support and download various game systems (e.g. Java games). In some implementations, the electronically customizable article may include pre-downloaded games.

In some implementations, the electronically customizable article may include wireless credit card features and terminals allowing for on-device purchasing of computer and software applications or other applications and programs, installation and updates.

In some implementations, the electronically customizable article may include security features such as password requirements or biometric components to operate article or certain features of article to aid in protection of confidential information.

In some implementations, the electronically customizable article may use computer, mobile or software applications in conjunction with features of the device, such as a built in camera and video capture abilities to help color coordinate articles of clothing with the device by visual input from the camera of the device of colors, designs, images or patterns of a user's clothing which are then interpreted by the application into matching colors, designs, patterns or images that may then be displayed on unit by use of the application.

In some implementations, the electronically customizable article may be configured to connect with a mobile device via Bluetooth connectivity, for example, to display visual notification of incoming calls, text messages, calendar dates, email messages or voicemail messages.

In some implementations, the electronically customizable article may include a GPS receiver for locating unit and navigation capabilities. The GPS receiver and transmitter may be used to track device if lost or stolen. In some implementations, through the use of computer or mobile applications or other wireless communication operating system, selected retail information may be relayed to the electronically customizable article in visual and or audible notifications of information such as sales, coupons and rebates dependent on the location of the device in the vicinity of the retail store with GPS use.

In some implementations, the electronically customizable article may include E-Reader capabilities for E-Books, magazines, newspapers and other reading articles on a possible fee basis. Text and images may be displayed in formats such as, but not limited to or required to include PDF, TXT, CHM, DOC, EXEL, EPUB, RTEF, and PUB. In some implementations, the electronically customizable article may be configured to adjust the text size. In some implementations, the electronically customizable article may be configured to vocalize the text via an audio narrator feature.

In some implementations, the electronically customizable article may be powered by solar power or other sources of light, kinetic energy sources, lithium ion, lithium ion polymer, nickel cadmium, fuel cell or nickel metal hydride battery or a combination of the foregoing. The electronically customizable article may be recharged through USB to computer system, power adapter, wireless electricity, battery charger, battery charging pad or docking station. In some implementations, the electronically customizable article may be configured to recharge other items through USB port or other port connectivity.

In some implementations, the electronically customizable article may be turned on or off and placed in different operating modes (e.g., air mode). In some implementations, the electronically customizable article may be configured to display a default screen in certain modes. In some implementations, the default screen may be the screen view when the display is turned off.

In some implementations, the electronically customizable article may include battery conserving features including user operated dimming controls to control the amount of light emitted from unit and ambient light sensors with automatic dimming and brightening effects. In some implementations, the electronically customizable article may be configured to have image display time minimums, which may vary according to specifics of displayed image, including image format and size. As a result, image display length ranges may vary depending on the electronic visual display. In some implementations, the electronically customizable article may be configured to provide early notification of battery depletion with automatic display of default screen when battery is below a predetermined level.

In some implementations, the electronically customizable article may be enclosed in an exterior protective transparent touch sensitive shell that is in the shape of the article that may be clear, transparent and or translucent, waterproof, weatherproof, flexible, shatterproof and/or scratch resistant. All parts of the article or portions of the article maybe covered with the protective exterior shell dependent on the size, shape and type of article. The exterior protective shell may consist of different types of material such as plastics. Different types of material or plastics may include PVC, ABS, vinyl, PES, PET, PE, PU, HDPE, LDPE, PP, PS, PC, MF, PF, PEEK and or silicone.

The exterior of the electronically customizable article may include additional features such as decorations, ornamentation and or functional hardware features that maybe aesthetically appealing objects such as buttons, gems, jewels, zippers, belts, handles, straps, buckles, strings or laces, clasps, fasteners, closing devices, attachment devices, and other different types of hardware. Different texturized coverings may be added to some articles to help aid in the aesthetics of the article without hindering touch sensitive features or visibility of projected images. Hardware features may be added to the exterior of the article to aid in visual aesthetics or for functional purposes such as keeping device in an upright position, hanging position or viewing position or purpose. Functional hardware may also be used for purposes of docking the article to a docking station battery source if used or attaching device to a portable attachable keyboard that is either separate or may be combined with docking station to make use of the device as a laptop or personal computer format or position.

In some implementations, the electronically customizable article may include audio system components such as built in audio speakers, head phone port and microphone with voice recording abilities, input and output voice command abilities to process, interpret and functionalize sound, speaker phone and playback ability. In some implementations, the electronically customizable article may be configured to download music content via applications.

In some implementations, the electronically customizable article may include an audible alarm system that may be activated by user in potentially threatening events.

In some implementations, the electronically customizable article may be configured to play and display various music systems (e.g., mp3 player or media player).

In some implementations, the electronically customizable article may incorporate sound sensors that may activate visual simulation of displayed images or colors with sound e.g., displayed color changes with received sound frequencies.

In some implementations, the electronically customizable article may serve as an alert system for incoming calls, text messages, emails, calendar events, alarm clock alerts, traffic alerts, car and home alarm system alerts and other alerts.

In some implementations, the electronically customizable article may include one or more of the following features: fingerprint scanners or other biometric techniques (for purses, wallets, suitcases etc.), audio panic alarms, sensor activated interior color illuminations (for purses, bags, backpacks etc.), touchscreen security code options to open, close or operate articles, automatic closing apparatus (for purses, backpacks, laptop bags etc.), integrated hanging apparatus (e.g. purses), elongating or retractable adjustable straps (e.g. purses, laptop bags and backpacks), Integrated image projectors (e.g. briefcase and phones), adjustable components of articles (e.g. the height or heel of shoe or ability to convert style of shoe from e.g. open toe or closed toe), cooling and warming material features on select articles (e.g. shoes), motion sensors with visual pulse, pedometer and estimated calorie burner display on shoes with information recording ability, adjustable cushioning in shoes to aid in comfort, removable/interchangeable customizing handles and inner material lining for (e.g. purses).

FIG. 1 illustrates an example environment 100 of the present disclosure for setting or changing the outer appearance of an electronically customizable article. As shown in FIG. 1, the environment 100 may include client devices 110*a* and 110*b* (collectively client device 110), an electronically customizable article 115 with display 117, a wireless cellular network 120, network 125, a server 130, and a data storage 135.

Client devices 110*a* and 110*b* are depicted as a mobile phone 110*a* and desktop computer 110*b*, respectively, but client devices 110 may comprise any type of computing device, such as a desktop computer system, a laptop, a smartphone, a mobile telephone, a tablet-style computer, or any other handheld electronic device.

In some implementations, the client device 110*a* or the electronically customizable article 115 may connect to the network 125 through a wireless cellular network 120, such as GPRS-based and CDMA-based wireless networks, as well as 802.16 WiMax and long-range wireless data networks.

The network 125 may be an intranet, an extranet, a virtual private network (VPN), a local area network (LAN), a wireless LAN (WLAN), a wide area network (WAN), a metropolitan area network (MAN), a portion of the Internet, or another network 125 or a combination of two or more such networks. The present disclosure contemplates any suitable network 125.

One or more links 127 couple an electronically customizable article 115, a server 130, or a client 110*b* to network 125. In some implementations, one or more links 127 each may include one or more wired, wireless, or optical links. In some implementations, one or more links 127 each may include an intranet, an extranet, a VPN, a LAN, a WLAN, a WAN, a MAN, a portion of the Internet, or another link or a combination of two or more such links. The present disclosure contemplates any suitable links 127 coupling electronically customizable article 115, servers 130 and clients 110*b* to network 125.

One or more links 129 couple an electronically customizable article 115 to a client 110. In some implementations, one or more links 129 each may include one or more wired, wireless, or optical links. In some implementations, one or more links 129 each may include an intranet, an extranet, a WI-FI network, a wireless cellular network, a Wi-Max network, a long-range wireless data network, an ad hoc network, a personal area network (PAN) (such as BLUETOOTH), a VPN, a LAN, a WLAN, a WAN, a MAN, a portion of the Internet, or another link or a combination of two or more such links. In some implementations, links 129 may include cable or connectors (e.g., USB cables) or a storage medium such as a flash drive, memory card, or other data storage device. The present disclosure contemplates any suitable links 129 coupling electronically customizable article 115 to clients 110.

Client devices 110*a*, 110*b* and the electronically customizable article 115 may interact with the server 130 via an application, such as a web browser or a native application including a mobile application, residing on the client devices 110*a*, 110*b* and electronically customizable article 115 to create, download, order, or configure images (still, video, graphic, or any other display item) to display on the electronically customizable article 115. In some implementations, the server 130 may be a social media site, such as Twitter, an e-mail server, other social-networking websites, shopping sites, review sites, and any third-party website to interact with content or other users. This disclosure contemplates any type of server 130 connected to network 125.

In some implementations, server 130 may be a unitary server or may be a distributed server spanning multiple computers or multiple datacenters. Server 130 may be of various types, such as, for example and without limitation, web server, news server, mail server, message server, advertising server, file server, application server, exchange server, database server, or proxy server. In some implementations, Server 130 may include hardware, software, or embedded logic components or a combination of two or more such components for carrying out the appropriate functionalities implemented or supported by Server 130. For example, a web server is generally capable of hosting websites containing web pages or particular elements of web pages. More specifically, a web server may host HTML files or other file types, or may dynamically create or constitute files upon a request, and communicate them to clients 110 and electronically customizable article 115 in response to HTTP or other requests from clients 110 and electronically customizable article 115. A mail server is generally capable of providing electronic mail services to various clients 110 and electronically customizable article 115. A database server is generally capable of providing an interface for managing data stored in one or more data stores.

In some implementations, one or more data storages 135 may be communicatively linked to server 130 via one or more links 127. In some implementations, data storages 135 may be used to store various types of information. In some implementations, the information stored in data storages 135 may be organized according to specific data structures. In particular embodiment, each data storage 135 may be a relational database. Particular embodiments may provide interfaces that enable server 130 or clients 110, 115 to manage, e.g., retrieve, modify, add, or delete, the information stored in data storage 135.

Client devices 110*a*, 110*b* and the electronically customizable article 115 may interact with each other via an application residing on the client devices 110*a*, 110*b* and electronically customizable article 115 to create, download, or configure images (still, video, graphic, or any other display item) to display on the electronically customizable article 115.

In some implementations, each client 110 may be an electronic device including hardware, software, or embedded logic components or a combination of two or more such components and capable of carrying out the appropriate functions implemented or supported by electronically customizable article 115. For example and without limitation, a client 110*b* may be any type of computing device such as a desktop computer system, a laptop, a smartphone, a mobile telephone, a tablet-style computer, or any other handheld electronic device. Electronically customizable article 115 may be configured to carry out the function of a computing device such as a laptop, a smartphone, a mobile telephone, a tablet-style computer, or any other handheld electronic device. The present disclosure contemplates any suitable mobile computing device. A client devices 110 may enable a network user at electronically customizable article 115 to access network 127. A client devices 110 may enable its user to communicate with other users at other electronically customizable article 115.

A client 110, 115 may have a web browser, such as MICROSOFT INTERNET EXPLORER, GOOGLE CHROME, MOZILLA FIREFOX, or any other future developed web browser and may have one or more add-ons, plug-ins, or other extensions. A user at client 110 and electronically customizable article 115 may enter a Uniform Resource Locator (URL) or other address directing the web browser to a server 130, and the web browser may generate a Hyper Text Transfer Protocol (HTTP) request and communicate the HTTP request to server 130. Server 130 may accept the HTTP request and communicate to client 110 and electronically customizable article 115 one or more Hyper Text Markup Language (HTML) files responsive to the HTTP request. Client 110 and electronically customizable article 115 may render a web page based on the HTML files from server 130 for presentation to the user. The present disclosure contemplates any suitable web page files. As an example and not by way of limitation, web pages may render from HTML files, Extensible Hyper Text Markup Language (XHTML) files, or Extensible Markup Language (XML) files, according to particular needs. Such pages may also execute scripts such as, for example and without limitation, those written in JAVASCRIPT, JAVA, MICROSOFT SILVERLIGHT, combinations of markup language and scripts such as AJAX (Asynchronous JAVASCRIPT and XML), and the like. Herein, reference to a web page encompasses one or more corresponding web page files (which a browser may use to render the web page) and vice versa, where appropriate.

Figure 3:
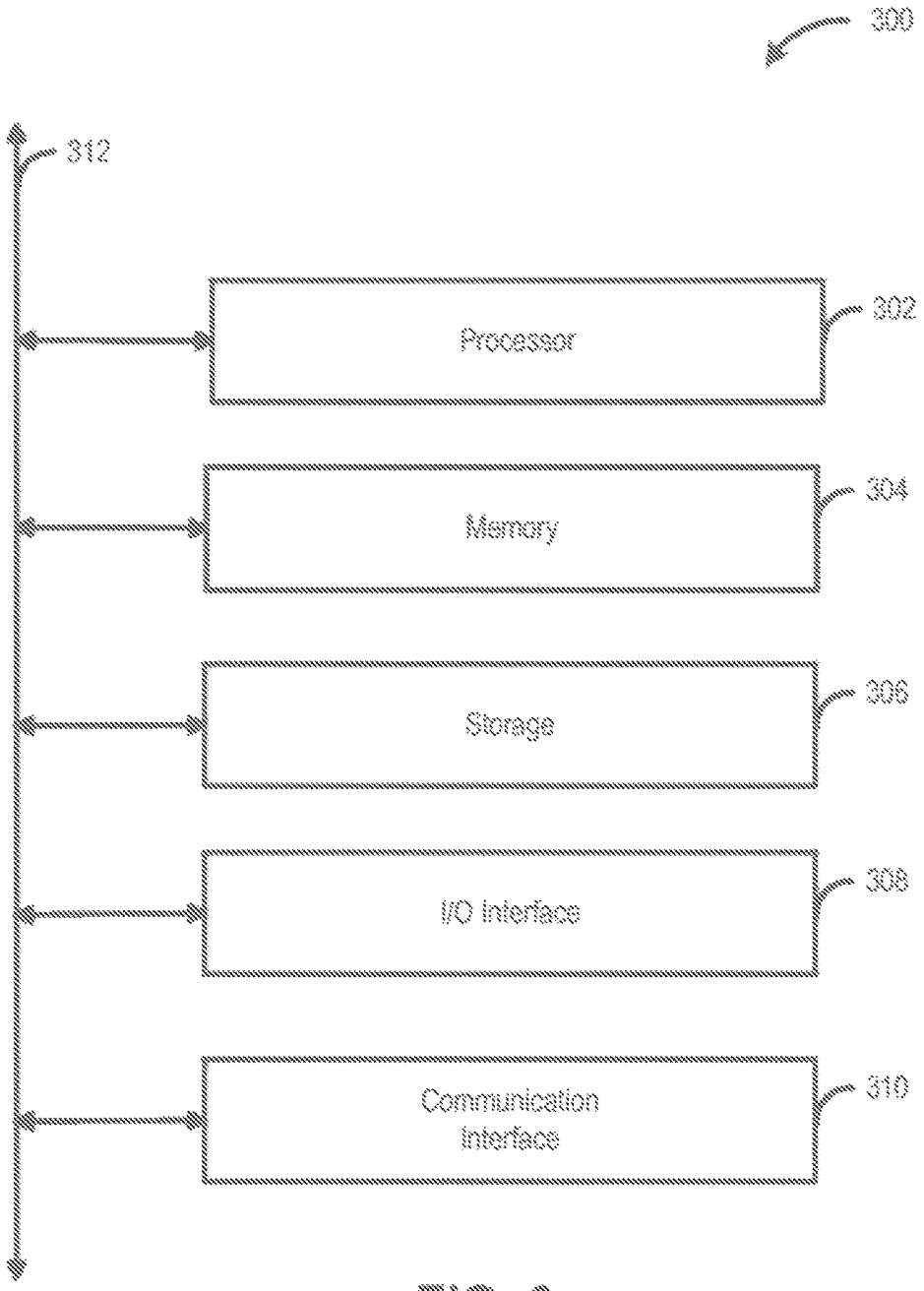
FIG. 3 illustrates an example computer system which may be used with some embodiments of the present invention.

FIG. 3 illustrates an example computer system 300, which may be used with some embodiments of the present disclosure. FIG. 3 illustrates an example computer system for a client device or electronically customizable article. This disclosure contemplates any suitable number of computer systems 300. This disclosure contemplates computer system 300 taking any suitable physical form. As example and not by way of limitation, computer system 300 may be an embedded computer system, a system-on-chip (SOC), a single-board computer system (SBC) (such as, for example, a computer-on-module (COM) or system-on-module (SOM)), a desktop computer system, a laptop, an interactive kiosk, a mainframe, a mesh of computer systems, a mobile telephone, a personal digital assistant (PDA), a server, or a combination of two or more of these. Where appropriate, computer system 300 may include one or more computer systems 300; be unitary or distributed; span multiple locations; span multiple machines; or reside in a cloud, which may include one or more cloud components in one or more networks. Where appropriate, one or more computer systems 300 may perform without substantial spatial or temporal limitation one or more steps of one or more methods described or illustrated herein. As an example and not by way of limitation, one or more computer systems 300 may perform in real time or in batch mode one or more steps of one or more methods described or illustrated herein. One or more computer systems 300 may perform at different times or at different locations one or more steps of one or more methods described or illustrated herein, where appropriate.

In some implementations, computer system 300 includes a processor 302, memory 304, storage 306, an input/output (I/O) interface 308, a communication interface 310, and a bus 312. Although this disclosure describes and illustrates a particular computer system having a particular number of particular components in a particular arrangement, this disclosure contemplates any suitable computer system having any suitable number of any suitable components in any suitable arrangement.

In some implementations, processor 302 includes hardware for executing instructions, such as those making up a computer program. As an example and not by way of limitation, to execute instructions, processor 302 may retrieve (or fetch) the instructions from an internal register, an internal cache, memory 304, or storage 306; decode and execute them; and then write one or more results to an internal register, an internal cache, memory 304, or storage 306. In some implementations, processor 302 may include one or more internal caches for data, instructions, or addresses. The present disclosure contemplates processor 302 including any suitable number of any suitable internal caches, where appropriate. As an example and not by way of limitation, processor 302 may include one or more instruction caches, one or more data caches, and one or more translation look-aside buffers (TLBs). Instructions in the instruction caches may be copies of instructions in memory 304 or storage 306, and the instruction caches may speed up retrieval of those instructions by processor 302. Data in the data caches may be copies of data in memory 304 or storage 306 for instructions executing at processor 302 to operate on; the results of previous instructions executed at processor 302 for access by subsequent instructions executing at processor 302 or for writing to memory 304 or storage 306; or other suitable data. The data caches may speed up read or write operations by processor 302. The TLBs may speed up virtual-address translation for processor 302. In some implementations, processor 302 may include one or more internal registers for data, instructions, or addresses. The present disclosure contemplates processor 302 including any suitable number of any suitable internal registers, where appropriate. Where appropriate, processor 302 may include one or more arithmetic logic units (ALUs); be a multi-core processor; or include one or more processors 302. Although this disclosure describes and illustrates a particular processor, this disclosure contemplates any suitable processor.

In some implementations, memory 304 includes main memory for storing instructions for processor 302 to execute or data for processor 302 to operate on. As an example and not by way of limitation, computer system 300 may load instructions from storage 306 or another source (such as, for example, another computer system 300) to memory 304. Processor 302 may then load the instructions from memory 304 to an internal register or internal cache. To execute the instructions, processor 302 may retrieve the instructions from the internal register or internal cache and decode them. During or after execution of the instructions, processor 302 may write one or more results (which may be intermediate or final results) to the internal register or internal cache. Processor 302 may then write one or more of those results to memory 304. In some implementations, processor 302 executes only instructions in one or more internal registers or internal caches or in memory 304 (as opposed to storage 306 or elsewhere) and operates only on data in one or more internal registers or internal caches or in memory 304 (as opposed to storage 306 or elsewhere). One or more memory buses (which may each include an address bus and a data bus) may couple processor 302 to memory 304. Bus 312 may include one or more memory buses, as described below. In some implementations, one or more memory management units (MMUs) reside between processor 302 and memory 304 and facilitate accesses to memory 304 requested by processor 302. In some implementations, memory 304 includes random access memory (RAM). This RAM may be volatile memory, where appropriate, this RAM may be dynamic RAM (DRAM) or static RAM (SRAM). Moreover, where appropriate, this RAM may be single-ported or multi-ported RAM. The present disclosure contemplates any suitable RAM. Memory 304 may include one or more memories 302, where appropriate. Although this disclosure describes and illustrates particular memory, this disclosure contemplates any suitable memory.

In some implementations, storage 306 includes mass storage for data or instructions. As an example and not by way of limitation, storage 306 may include an HDD, a floppy disk drive, flash memory, an optical disc, a magneto-optical disc, magnetic tape, or a Universal Serial Bus (USB) drive or a combination of two or more of these. Storage 306 may include removable or non-removable (or fixed) media, where appropriate. Storage 306 may be internal or external to computer system 300, where appropriate. In some implementations, storage 306 is non-volatile, solid-state memory. In some implementations, storage 306 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. This disclosure contemplates mass storage 306 taking any suitable physical form. Storage 306 may include one or more storage control units facilitating communication between processor 302 and storage 306, where appropriate. Where appropriate, storage 306 may include one or more storages 306. Although this disclosure describes and illustrates particular storage, this disclosure contemplates any suitable storage.

In some implementations, I/O interface 308 includes hardware, software, or both providing one or more interfaces for communication between computer system 300 and one or more I/O devices. Computer system 300 may include one or more of these I/O devices, where appropriate. One or more of these I/O devices may enable communication between a person and computer system 300. As an example and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these. An I/O device may include one or more sensors. This disclosure contemplates any suitable I/O devices and any suitable I/O interfaces 308 for them. Where appropriate, I/O interface 308 may include one or more device or software drivers enabling processor 302 to drive one or more of these I/O devices. I/O interface 308 may include one or more I/O interfaces 308, where appropriate. Although this disclosure describes and illustrates a particular I/O interface, this disclosure contemplates any suitable I/O interface.

In some implementations, communication interface 310 includes hardware, software, or both providing one or more interfaces for communication (such as, for example, packet-based communication) between computer system 300 and one or more other computer systems 300 or one or more networks. As an example and not by way of limitation, communication interface 310 may include a network interface controller (NIC) or network adapter for communicating with an Ethernet or other wire-based network or a wireless NIC (WNIC) or wireless adapter for communicating with a wireless network, such as a WI-FI network. This disclosure contemplates any suitable network and any suitable communication interface 310 for it. As an example and not by way of limitation, computer system 300 may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, computer system 300 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), GPS, or other suitable wireless network or a combination of two or more of these. Computer system 300 may include any suitable communication interface 310 for any of these networks, where appropriate. Communication interface 310 may include one or more communication interfaces 310, where appropriate. Although this disclosure describes and illustrates a particular communication interface, this disclosure contemplates any suitable communication interface.

In some implementations, bus 312 includes hardware, software, or both coupling components of computer system 300 to each other. As an example and not by way of limitation, bus 312 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or another suitable bus or a combination of two or more of these. Bus 312 may include one or more buses 312, where appropriate. Although this disclosure describes and illustrates a particular bus, this disclosure contemplates any suitable bus or interconnect.

Figure 4:
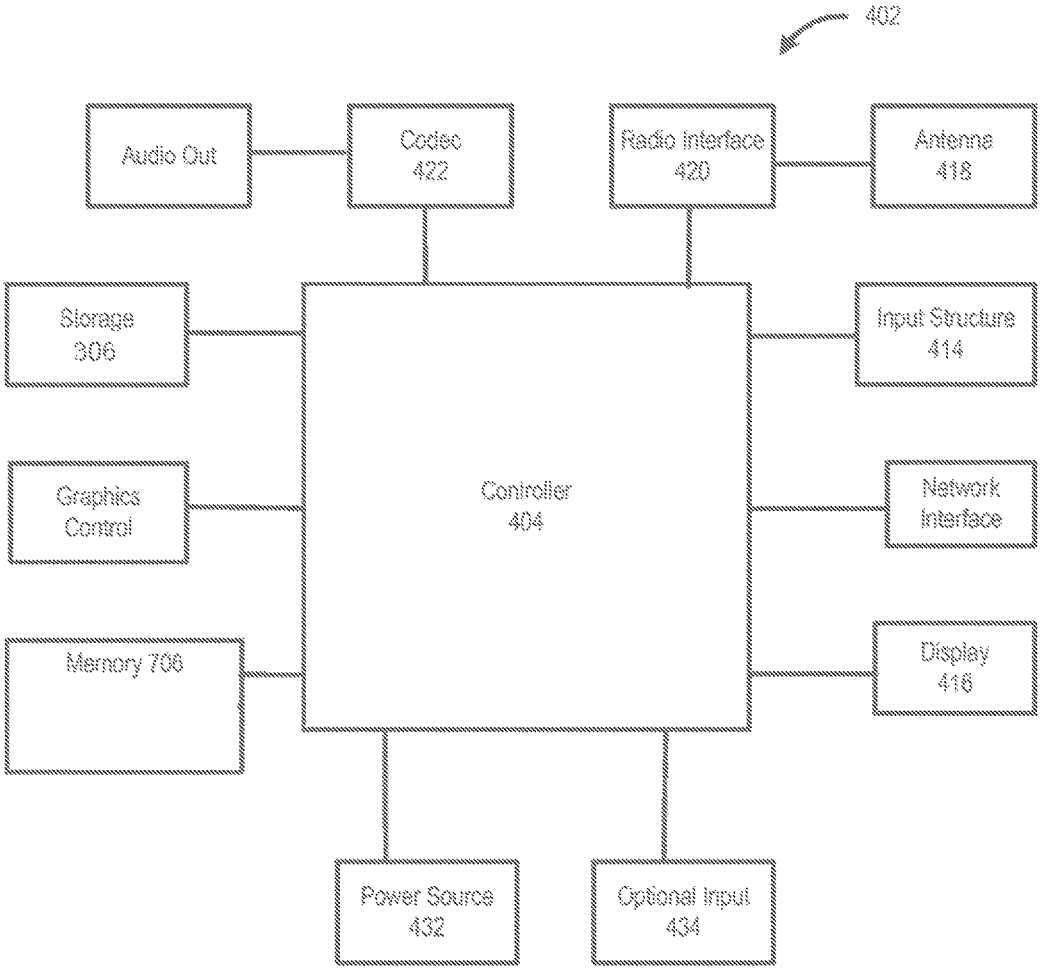
FIG. 4 shows a schematic representation of the main components of an example computing platform.

The client-side functionality described above may be implemented as a series of instructions stored on a computer-readable storage medium that, when executed, cause a programmable processor to implement the operations described above. While the client devices 110, 115 may be implemented in a variety of different hardware and computing systems, FIG. 4 shows a schematic representation of the main components of an example computing platform 402, according to various particular embodiments. Multipoint sensing devices generally include a controller 404 which may comprise a microcontroller or one or more processors configured to execute instructions and to carry out operations associated with a computing platform. In various embodiments, controller 404 may be implemented as a single-chip, multiple chips and/or other electrical components including one or more integrated circuits and printed circuit boards. Controller 404 may optionally contain a cache memory unit for temporary local storage of instructions, data, or computer addresses. By way of example, using instructions retrieved from memory, controller 404 may control the reception and manipulation of input and output data between components of computing platform 402.

Controller 404 together with a suitable operating system may operate to execute instructions in the form of computer code and produce and use data. By way of example and not by way of limitation, the operating system may be Windows-based, Mac-based, or Unix or Linux-based, or Symbian-based, among other suitable operating systems. The operating system, other computer code and/or data may be physically stored within a memory block 706 that is operatively coupled to controller 404.

Memory block 706 encompasses one or more storage media and generally provides a place to store computer code (e.g., software and/or firmware) and data that are used by the computing platform 402. By way of example, memory block 706 may include various tangible computer-readable storage media including Read-Only Memory (ROM) and/or Random-Access Memory (RAM). As is well known in the art, ROM acts to transfer data and instructions uni-directionally to controller 404, and RAM is used typically to transfer data and instructions in a bi-directional manner. Memory block 706 may also include one or more fixed storage devices in the form of, by way of example, solid-state hard disk drives (HDDs), among other suitable forms of memory coupled bi-directionally to controller 404. Information may also reside on a removable storage medium loaded into or installed in multipoint sensing devices when needed. By way of example, any of a number of suitable memory cards may be loaded into computing platform 402 on a temporary or permanent basis.

Controller 404 is also generally coupled to a variety of interfaces such as graphics control, video interface, input interface, output interface, and storage interface, and network interface, and these interfaces in turn are coupled to the appropriate devices. In certain embodiments, Controller 404 may be connected to an input structure 414 and display 416 may be provided together, such an in the case of a touch-screen where a touch sensitive mechanism is provided in conjunction with the display 416. In such embodiments, the user may select or interact with displayed interface elements via the touch sensitive mechanism. In this way, the displayed interface may provide interactive functionality, allowing a user to navigate the displayed interface by touching the display 416.

Controller 404 may receive instruction signals from input structure 414 and control the operation of display 416. By way of example, display 416 may incorporate liquid crystal display (LCD), light emitting diode (LED), Interferometric modulator display (IMOD), or any other suitable display technology. Audio signals may be transmitted and received by means of an antenna 418 that may be connected through a radio interface 420 or audio input interface such as microphone to codec 422 configured to process signals under control of controller 404. Additionally, multipoint sensing devices may be powered power source 432.

Client devices 110, 115 may also include one or more user input devices 434 (other than input structure 414) that are operatively coupled to the controller 404. Generally, input devices 434 are configured to transfer data, commands and responses from the outside world into multipoint sensing devices. By way of example, client devices 110, 115 may include a keyboard or mouse. Input devices 434 may also include one or more hard buttons.

Display device 416 is generally configured to display a graphical user interface (GUI) that provides an easy to use visual interface between a user of the computing platform 402 and the operating system or application(s) running on the client devices 110, 115. Generally, the GUI presents programs, files and operational options with graphical images. During operation, the user may select and activate various graphical images displayed on the display 416 in order to initiate functions and tasks associated therewith.

Herein, reference to a computer-readable storage medium encompasses one or more non-transitory, tangible computer-readable storage media possessing structure. As an example and not by way of limitation, a computer-readable storage medium may include a semiconductor-based or other integrated circuit (IC) (such, as for example, a field-programmable gate array (FPGA) or an application-specific IC (ASIC)), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, or another suitable computer-readable storage medium or a combination of two or more of these, where appropriate. Herein, reference to a computer-readable storage medium excludes any medium that is not eligible for patent protection under 35 U.S.C. .sctn.101. Herein, reference to a computer-readable storage medium excludes transitory forms of signal transmission (such as a propagating electrical or electromagnetic signal per se) to the extent that they are not eligible for patent protection under 35 U.S.C. .sctn.101.

This disclosure contemplates one or more computer-readable storage media implementing any suitable storage. In some implementations, a computer-readable storage medium implements one or more portions of processor 302 (such as, for example, one or more internal registers or caches), one or more portions of memory 304, one or more portions of storage 306, or a combination of these, where appropriate. In some implementations, a computer-readable storage medium implements RAM or ROM. In some implementations, a computer-readable storage medium implements volatile or persistent memory. In some implementations, one or more computer-readable storage media embody software. Herein, reference to software may encompass one or more applications, bytecode, one or more computer programs, one or more executables, one or more instructions, logic, machine code, one or more scripts, or source code, and vice versa, where appropriate. In some implementations, software includes one or more application programming interfaces (APIs). This disclosure contemplates any suitable software written or otherwise expressed in any suitable programming language or combination of programming languages. In some implementations, software is expressed as source code or object code. In some implementations, software is expressed in a higher-level programming language, such as, for example, C, Perl, or a suitable extension thereof. In some implementations, software is expressed in a lower-level programming language, such as assembly language (or machine code). In some implementations, software is expressed in JAVA. In some implementations, software is expressed in Hyper Text Markup Language (HTML), Extensible Markup Language (XML), or other suitable markup language.

The present disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend.

The foregoing description of the embodiments of the invention has been presented for the purpose of illustration; it is not intended to be exhaustive or to limit the invention to the precise forms disclosed. Persons skilled in the relevant art may appreciate that many modifications and variations are possible in light of the above disclosure. For example, although the foregoing embodiments have been described in the context of a social network system, it will apparent to one of ordinary skill in the art that the invention may be used with any electronic social network service and, even if it is not provided through a website. Any computer-based system that provides social networking functionality may be used in accordance with the present invention even if it relies, for example, on e-mail, instant messaging or other form of peer-to-peer communications, and any other technique for communicating between users. The invention is thus not limited to any particular type of communication system, network, protocol, format or application.

Some portions of this description describe the embodiments of the invention in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which may be executed by a computer processor for performing any or all of the steps, operations, or processes described. Embodiments of the invention may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a tangible computer readable storage medium or any type of media suitable for storing electronic instructions, and coupled to a computer system bus. Furthermore, any computing systems referred to in the specification may include a single processor or may be architectures employing multiple processor designs for increased computing capability.

While the foregoing processes and mechanisms may be implemented by a wide variety of physical systems and in a wide variety of network and computing environments, the server or computing systems described provide example computing system architectures for didactic, rather than limiting, purposes.

The present invention has been explained with reference to specific embodiments. For example, while embodiments of the present invention have been described as operating in connection with a social network system, the present invention may be used in connection with any communications facility that allows for communication of messages between users, such as an email hosting site. Other embodiments will be evident to those of ordinary skill in the art. It is therefore not intended that the present invention be limited, except as indicated by the appended claims.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

The invention claimed is:

1. An apparatus comprising:

a fashion article selected from the group consisting of the following: a handbag, shoes, glasses, a tie, a bowtie, a bracelet, a necklace, earrings, a ring, a garment, a name tag, a belt, a wallet, and optical frame, the fashion article comprising:

an electronic visual multi touch-sensitive hand writing recognition capable display integral with the fashion article, a sound sensor, at least one camera, a processor, a biometric component, wherein the biometric component is configured to operate the electronically customizable article, a location component, wherein the location component comprises at least one of a GPS receiver, a Bluetooth locator, and a Wi-Fi locator, a communication interface for communication between the fashion article and a network, and a non-transitory computer readable medium containing instructions that, when executed by the processor, causes the fashion article to:

display visual content on the electronic multi touch-sensitive hand writing recognition capable display, wherein the visual content comprises at least one of the following: an image, video, color, pattern and design, and further comprising a user selected set of images, receive sensor data, wherein the received sensor data comprises visual input from the camera, audio data and location information, manipulate the visual content to make the user selected set of images contextually relevant based on the visual input from the camera, wherein a modification comprises matching the user selected set of images based on the received visual input and wherein the electronic visual display is placed in a locked position thereby disabling accidental navigation while only displaying one or more of the user selected set of images, wherein the fashion article is further configured to, in response to the received sensor data:

modify the visual content based on the audio data, wherein a modification comprises a visual simulation of displayed visual content based on audio data, provide one or more audible notifications based on the location information, and provide one or more visual notifications based on the location information.

2. The electronically customizable article of claim 1, wherein the electronic visual multi touch-sensitive hand writing recognition capable display is configured to:

rotate the visual content on the electronic visual multi touch-sensitive hand writing recognition capable display based on a position of the electronically customizable article, and place the visual content in a locked position disabling any accidental navigation of display content.

3. The electronically customizable article of claim 2, further comprising a plurality of electronic visual multi touch-sensitive displays, wherein the electronic visual multi touch-sensitive displays are configured to be positioned at one or more positions on the fashion article; wherein the electronically customizable articles are configured to display content synchronously with one or more other electronic visual multi touch-sensitive displays.

4. The electronically customizable article of claim 3, wherein the electronically customizable article is configured to display content simultaneously or in synchronous with one or more other electronically customizable articles.

5. The electronically customizable article of claim 1, wherein the electronic visual multi touch-sensitive hand writing recognition capable display is configured to display data associated with an email.

6. The electronically customizable article of claim 1, wherein the electronic visual multi touch-sensitive hand writing recognition capable display is configured to display data associated with a text message.

7. The electronically customizable article of claim 1, wherein the electronic visual touch-sensitive hand writing recognition capable display is configured to display data associated with a news feed.

8. The electronically customizable article of claim 1, wherein the electronic visual multi touch-sensitive hand writing recognition capable display is configured to display data associated with a video.

9. The electronically customizable article of claim 1, wherein the electronic visual multi touch-sensitive hand writing recognition capable display is configured to display data associated with a video game.

10. The electronically customizable article of claim 1, wherein data associated with the visual content is received from a social media server and the electronically customizable article is configured to display social media content.

11. The electronically customizable article of claim 1, wherein the at least one camera is configured for recording video and wherein the electronically customizable article is configured to at least two of: playback, edit, and display the captured video on the electronic visual multi touch-sensitive hand writing recognition capable display.

12. The electronically customizable article of claim 1, wherein the fashion article is further configured to:

receive the audio file from at least one of a server and a communication interface, and cause an audio system of the electronically customizable article to produce sound from at least two of:

playback of the audio file, vocalization of text via an audio narrator feature, and activation of an audible alarm system on an integrated speaker of the electronically customizable article.

13. The electronically customizable article of claim 1, wherein a manipulation of the displayed content further comprises at least one of the following modifications: color, color depth, brightening and contrast adjustments, special effects, softening options, sharpening abilities, image enhancing, image rotating, selective color changing, cropping, and size adjustments;

wherein displaying visual content further comprises adding a lighting show to a still image; and wherein adding a lighting show to a still image further comprises emitting at least one of: pulsating light and flashing light at portions of the still image.

14. The electronically customizable article of claim 13, wherein a manipulation of the displayed content further comprises at least one of the following modifications: displaying a specified order and timing of images, colors, designs, patterns, or multiple visual images synchronously on a plurality of electronic visual touch-sensitive displays or a plurality of electronically customizable articles.

* * * * *